US009506621B2

(12) United States Patent
Fu

(10) Patent No.: US 9,506,621 B2
(45) Date of Patent: Nov. 29, 2016

(54) KNOCK-DOWN SHADE USING REPURPOSED PACKAGING

(71) Applicant: Arcadia, Taipei (TW)

(72) Inventor: Jeff Fu, Taipei (TW)

(73) Assignee: ARCADIA, Taipei (TW)

( * ) Notice: Subject to any disclaimer, the term of this patent is extended or adjusted under 35 U.S.C. 154(b) by 147 days.

(21) Appl. No.: 14/468,791

(22) Filed: Aug. 26, 2014

(65) Prior Publication Data

US 2016/0061405 A1 Mar. 3, 2016

(51) Int. Cl.

| | |
|---|---|
| ***F21V 1/06*** | (2006.01) |
| ***F21V 1/26*** | (2006.01) |
| ***F21S 6/00*** | (2006.01) |
| ***B65B 5/04*** | (2006.01) |
| ***F21V 17/00*** | (2006.01) |
| *F21W 131/30* | (2006.01) |

(52) U.S. Cl.

CPC . *F21V 1/06* (2013.01); *B65B 5/04* (2013.01); *F21S 6/005* (2013.01); *F21V 1/26* (2013.01); *F21V 17/007* (2013.01); *F21W 2131/30* (2013.01)

(58) Field of Classification Search

CPC ..... F21V 1/06; F21V 1/18; F21V 1/26; B65B 5/04

USPC ..... 362/352

See application file for complete search history.

(56) References Cited

U.S. PATENT DOCUMENTS

| | | | | |
|---|---|---|---|---|
| 1,875,455 | A | 9/1932 | Hayes et al. | |
| 2,819,386 | A * | 1/1958 | Linderoth | F21V 1/00 362/352 |
| 3,142,446 | A | 7/1964 | Okamoto | |
| 4,772,992 | A | 9/1988 | Tang | |
| 6,752,263 | B2 | 6/2004 | Dubsky | |
| 6,857,766 | B2 * | 2/2005 | Verdi | F21V 1/16 362/357 |
| 2008/0130297 | A1 * | 6/2008 | Hui | F21V 1/06 362/352 |

FOREIGN PATENT DOCUMENTS

| | | |
|---|---|---|
| CN | 2593041 | 12/2003 |

OTHER PUBLICATIONS

Puja Lalwani, "Tips to buy a lampshapde that suits your lamp", Oct. 30, 2013, Buzzle, http://www.buzzle.com/articles/tips-to-buy-a-lampshade-that-suits-your-lamp.html.*

Ed Chew [Designer], Troy Turner [Author], "Liquid to Light", Apr. 11, 2011, Yanko Design, http://www.yankodesign.com/2011/04/11/liquid-to-light/.*

* cited by examiner

*Primary Examiner* — Anh Mai
*Assistant Examiner* — Matthew Peerce
(74) *Attorney, Agent, or Firm* — Leason Ellis LLP

(57) ABSTRACT

A method of assembling a knocked-down shade and a shade assembly are described, which use a product packaging sleeve repurposed from product packaging. The knock-down shade assembly has a flexible shade cover, a top rigid member with an UNO fitting, a bottom rigid member, a plurality of clips, and a product packaging sleeve that functions as a support liner for the flexible shade cover. Likewise, the flexible articles can be assembled and provided in accordance with this discussion.

7 Claims, 8 Drawing Sheets

500
510
320
7
7
300
210
310
600
200
220

KNOCK-DOWN SHADE USING REPURPOSED PACKAGING

FIELD OF THE INVENTION

The present invention relates to an improved knock-down shade and other knock-down flexible objects and in particular, to a knock-down shade that repurposes product packaging or other protective materials to provide support and maintain the shape of the flexible shade.

BACKGROUND OF THE INVENTION

Shipping and packaging costs can greatly increase the cost of a lamp, among other products. Such costs are directly passed on from the manufacturers and retailers to the end consumer. Lamp shades are often delicate, and require a substantial amount of packing to ensure that they are not damaged during transport. After a retailer or consumer receives a shipment with a lamp shade, they often unpack the lamp shade and dispose of the packing material. While some packing materials can be recycled, retailers and consumers do not always recycle them. The disposal of these packing materials adds to the massive amount of garbage that is produced each year. It would therefore be beneficial to find a way to reduce the waste generated from shipping lamp shades.

Shipping and packaging costs are also affected by the size of the lamp shade. Because of a traditional lamp shade's shape, its shipping boxes are usually large and contain wasted space. This extra box volume adds to transportation and storage costs, and ultimately adds to the final sale price of the lamp shade. Thus, it would be beneficial to find a way to reduce the size of the lamp shade for shipping.

The prior art contains examples of collapsible lamp shades that can reduce the size of the lamp shade for transport and storage. Examples of such lamp shade assemblies include U.S. Pat. No. 3,142,446 and U.S. Pat. No. 4,772,992. Prior art collapsible lamp shades utilize self-supporting shades, removable rings, radial supports or vertical supports to maintain the shape of the shade. However, these prior art collapsible lamp shades are still shipped with packing material that is disposed of after they arrive at their destination, and do not attempt to repurpose any packaging material that accompanies the shade. Therefore, it would be an improvement in the art to further reduce the shipping cost and amount of garbage that is produced from shipping lamp shades and certain other flexible products.

SUMMARY OF THE INVENTION

In accordance with one aspect of the present invention, a method of assembling a knock-down flexible lamp shade is disclosed. The method is to be used for a knocked-down shade that is suitable for covering a bulb that is seated or screwed into a lamp base. The method further is to be used with a flexible shade that has a top edge with a top opening, a bottom edge with a bottom opening, a top rigid member with an UNO fitting for engaging the bulb of the lamp or a lamp socket, and a bottom rigid member. The method comprises disposing a product packaging sleeve along the interior surface of the flexible shade so that the sleeve provides structural integrity to the flexible shade, clipping the bottom rigid member to the interior of the flexible shade, and clipping the top rigid member to the interior of the flexible shade. In certain embodiments, providing clips is a part of the inventive method.

In other aspects of the invention, the method includes removing the knocked-down flexible shade from the product packaging sleeve prior to disposing the product packaging sleeve along the interior surface of the flexible shade. In various embodiments of the invention, the product packaging can be made continuous in different ways, such as arriving as a continuous sleeve or requiring the ends of the sleeve to be brought together.

Another aspect of the invention discloses a method of installing the top rigid member where it is positioned below the first set of clips, and then the top rigid member is moved up to and secured in the first set of clips.

In certain preferred embodiments, the top and bottom rigid members are secured into clips proximate to the top and bottom edge of the flexible shade, respectively. Such embodiments may also result in the top and bottom rigid members pressing against the product packaging sleeve to secure the product packaging sleeve in place. The invention may also include placing the flexible shade in its expanded state on a bulb or lamp base to form a complete lamp and shade structure that can be sold or used.

Another aspect of the invention disclosed is a flexible lamp shade assembly that has two rigid support members and clips, and an interior support provided by product packaging for structural integrity and to maintain the shape of the flexible lamp shade. The product packaging is in the form of a sleeve, and consists of cardboard in a preferred embodiment. In certain embodiments of the invention, the flexible shade and rigid members may be any suitable shape. The rigid members may also have different perimeters. A preferred embodiment uses six clips total, three in the top set of clips and three in the bottom set of clips, but any number of suitable clips may be used.

In accordance with still a further aspect of the present invention, a method of assembling a knock-down flexible article is disclosed. The method is to be used for an article having a knocked-down state and a second, stretched state in which the article is taut. The method further is to be used with such an article by disposing a product packaging component along the interior surface of the flexible article so that the sleeve provides structural integrity to the flexible article, clipping at least a first and second rigid member at spaced locations within the interior of the flexible article, such as at a top and bottom portion thereof. In certain embodiments, providing clips is a part of this inventive method.

It will be appreciated that this invention may be applicable to other knocked-down flexible objects.

These and other aspects, features and advantages shall be apparent from the accompanying drawings and description of certain embodiments of the invention.

DETAILED DESCRIPTION OF CERTAIN EMBODIMENTS OF THE INVENTION

Figure 1:
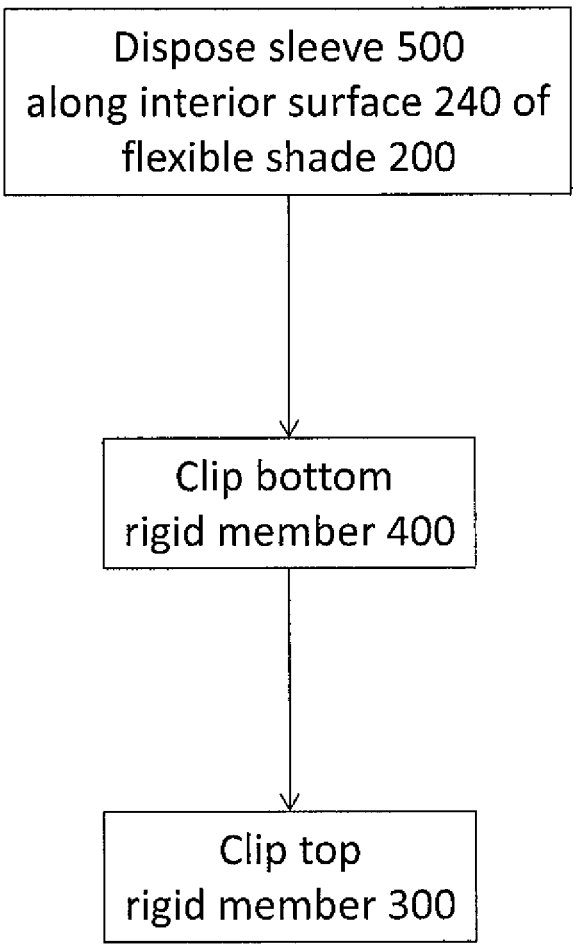
FIG. 1 depicts a flowchart of the steps performed when assembling a knock-down shade according to one embodiment of the invention.
Figure 2:
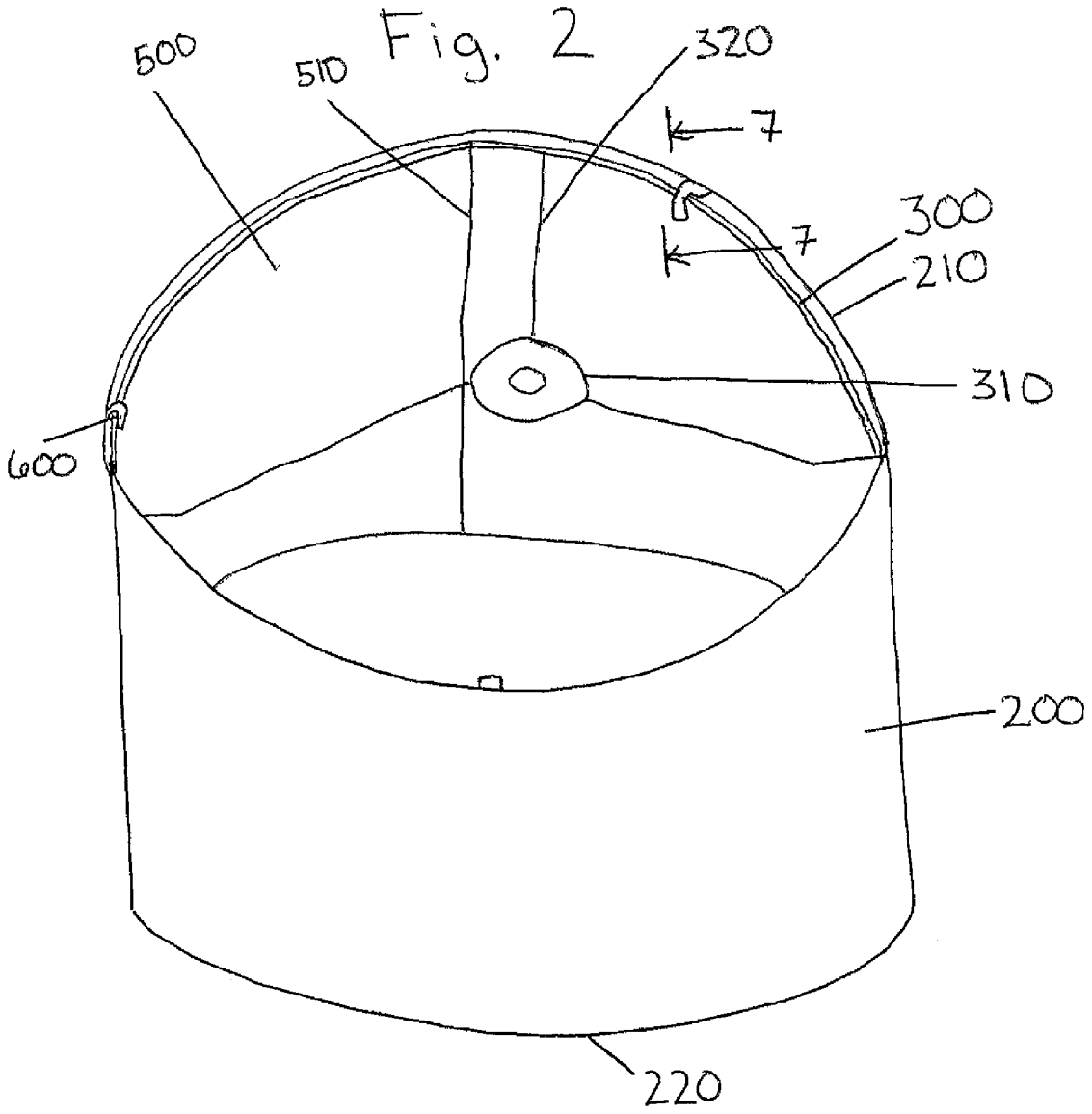
FIG. 2 is a perspective view of the knock-down shade assembly according to one embodiment of the invention.

Referring to FIGS. 1 and 2, a knocked-down shade 200 can be assembled that is suitable for covering a bulb, such as light bulb or other bulb capable of emitting light, and can be seated within a lamp base. Configurations for a lamp base that can seat a bulb are well-known in the prior art. Lamp bases can be different sizes and shapes, and contain a lamp socket that is used to hold the bulb in place. Common prior art lamp sockets are designed so that a portion of the bulb can be screwed into and secured within the lamp socket. The lamp socket may also contain a device, such as a pull-string or knob, which can be used to turn the bulb on and off when connected to a suitable power source. According to the present invention, the flexible shade 200 can be made of any flexible material, such as burlap or silk, to give the desired aesthetic appearance. The flexible shade must also have a top edge with a top opening 210 and a bottom edge with a bottom opening 220. It should be appreciated that the top and bottom openings 210 and 220 of the flexible shade 200 can be any suitable shape, including circular, oblong, triangular, square, diamond, pentagular, or octangular, or size. The flexible shade must also have an interior surface 240 and an exterior surface 230.

Figure 3:
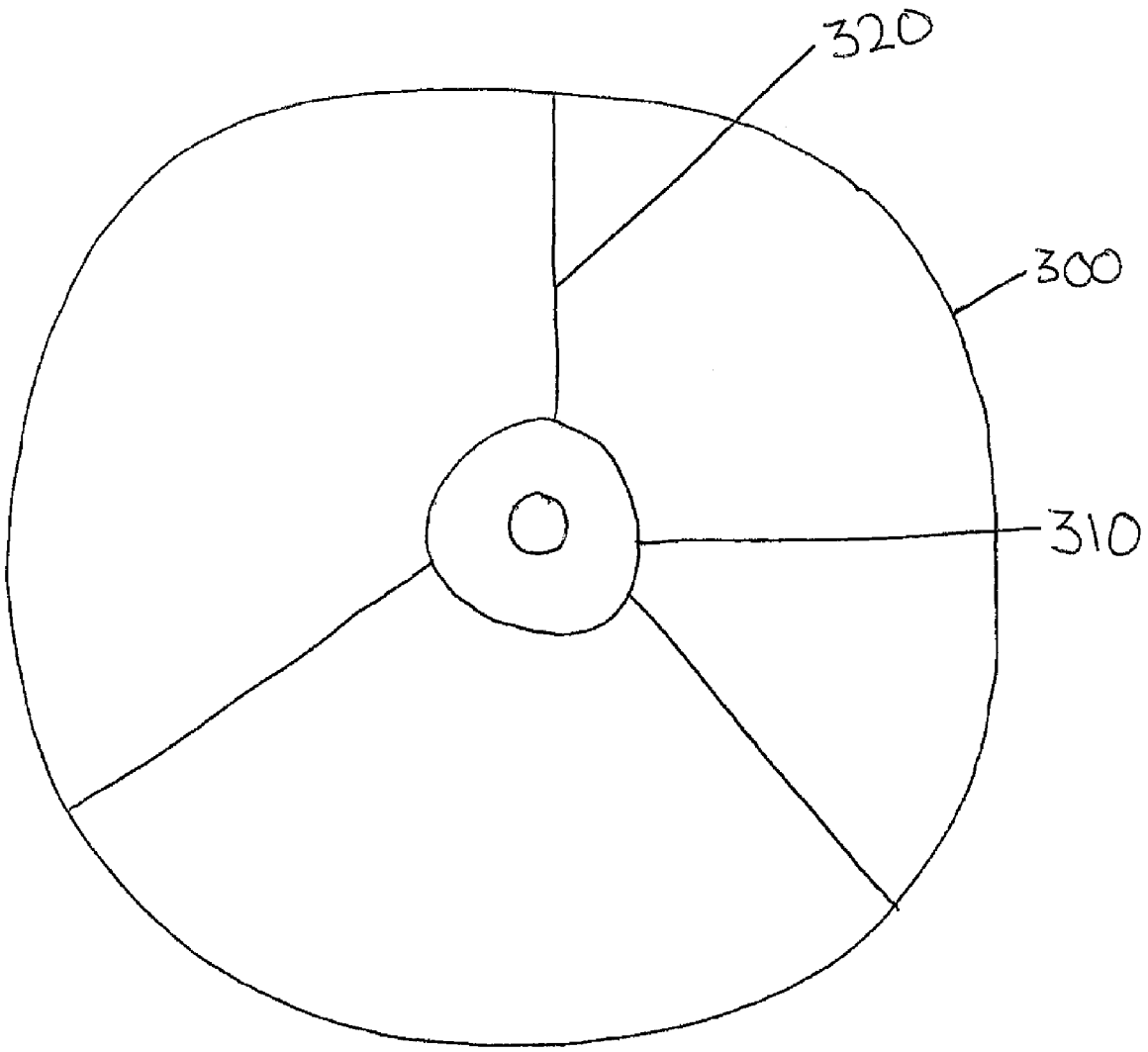
FIG. 3 is a plan view of the UNO ring.
Figure 5:
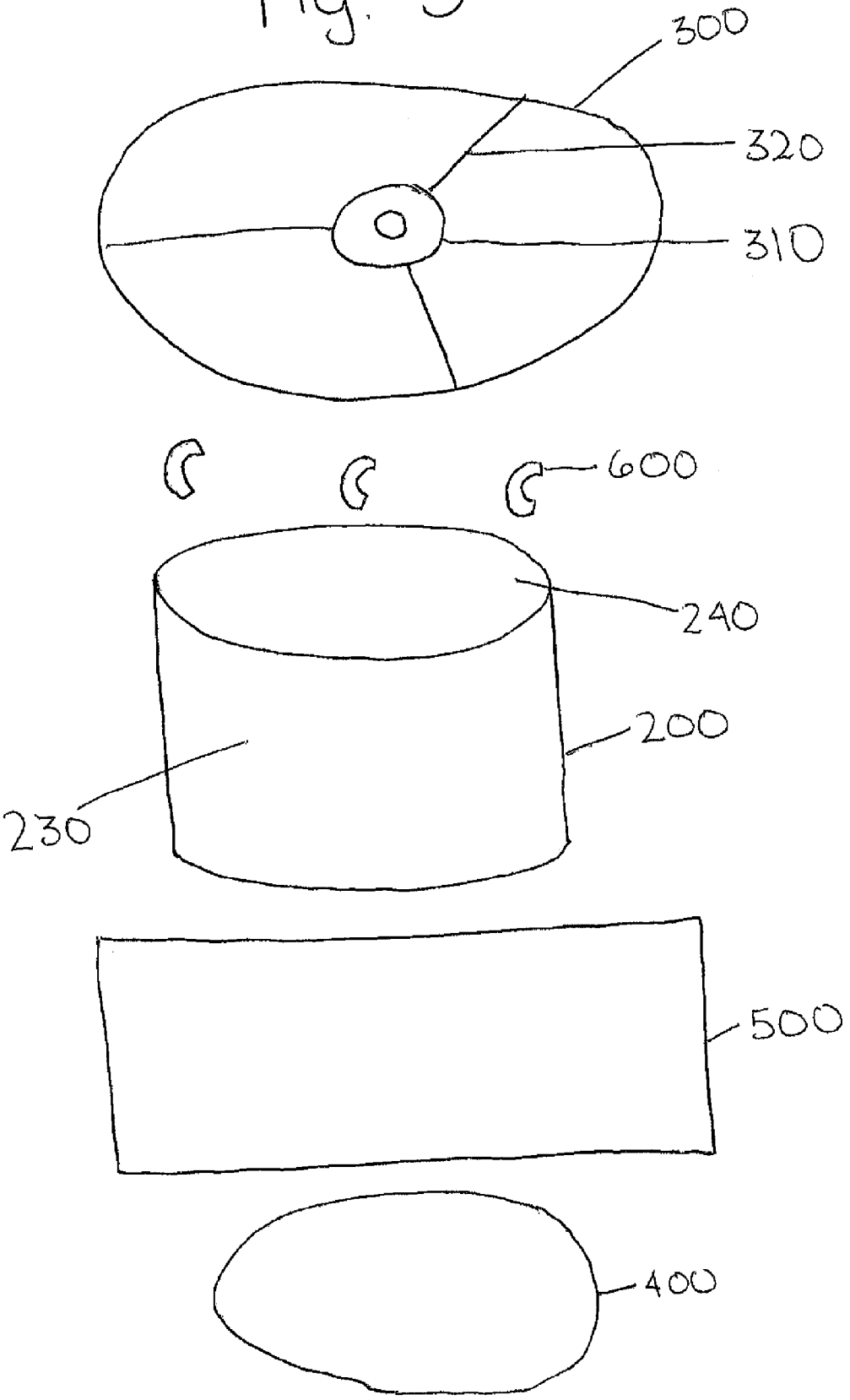
FIG. 5 is an exploded perspective view of the knock-down shade assembly shown in FIG. 4.

As shown in FIGS. 2 and 5, the knock-down shade assembly contains a top rigid member 300 having an UNO fitting 310 for engaging the bulb of the lamp or the lamp socket and a bottom rigid member 400. The top rigid member 300 and bottom rigid member 400 can be made of any suitable material, including plastic or metal. Rigid members 300 and 400 do not need to be made of the same material. However, rigid members 300 and 400 must be made of a material that is sufficiently rigid so as to keep the members' shape and not break when the members are clipped to the flexible shade 200. FIG. 3 shows an embodiment of the top rigid member 300 with an outer edge and an UNO fitting 310. In this embodiment, the UNO fitting 310 is disposed in the center of a circular top rigid member 300. The UNO fitting 310 is connected to the top rigid member by a plurality of supports 320, which extend radially from the UNO fitting 310 to the edge of the top rigid member 300. It will be appreciated that the supports 320 can be of any suitable length, and may also be bent or curved so as to properly dispose a bulb within the flexible shade 200. The top rigid member 300, UNO fitting 310, or supports 320 may be connected to the lamp base, bulb or socket in a variety of ways, all of which are conventional in the art. When the flexible shade is assembled, as shown in FIG. 2, the outer edge of the top rigid member 300 and the outer edge of the bottom rigid member are secured by a plurality of clips 600. While it is not required, bottom rigid member 400 may also have supports, such as those shown as supports 320.

The rigid members 300 and 400 may be different shapes and sizes. In one embodiment, the top rigid member 300 is round and has a smaller diameter than the round bottom rigid member 400. In a different embodiment, the top rigid member 300 may be round, while the bottom rigid member 400 may be square. Round rigid members are also referred to herein as rings.

The designations "top" and "bottom" used herein to describe the rigid members 300 and 400 and the edges of flexible shade 210 and 220 are used for convenience, and should not be viewed as limiting the directionality of the shade. It will be appreciated that embodiments of this invention can have the top rigid member 300 with an UNO fitting 310 either above or below a light bulb in a lamp. Embodiments of this invention can be used for all types of lamps, including table lamps, floor lamps, arced floor lamps, flush mount lamps and ceiling hung lamps. In a ceiling hung lamp, for example, the top rigid member 300 with an UNO fitting 310 would be closer to the ceiling and the bottom rigid member 400 would be closer to the ground. In this configuration, the light bulb is screwed into the lamp base upside down. A tradition floor lamp may have the opposite configuration, where the top rigid member 300 with an UNO fitting 310 is closer to the ground, the bottom rigid member 400 is closer to the ceiling, and the bulb is installed right-side up so that the portion of the bulb that is screwed into the lamp base is the closest portion of the bulb to the ground.

The preferred embodiment of the invention utilizes a plurality of clips 600 to secure or engage the top rigid member 300 and bottom rigid member 400 against the interior of the flexible shade 200, as shown in FIG. 5. The plurality of clips 600 may be secured anywhere along the interior of the flexible shade 200, with the preferred embodiment having an equal number of clips 600 near the top edge 210 and near the bottom edge 220 of the flexible shade 200. Such a configuration is shown in FIG. 2. Any number of clips 600 can be used as required to hold the top rigid member 300 and bottom rigid member 400 in place. In one embodiment, three equally spaced clips 600 are used to secure the top rigid member 300 and three equally spaced clips 600 are used to secure the bottom rigid member 400.

Figure 4:
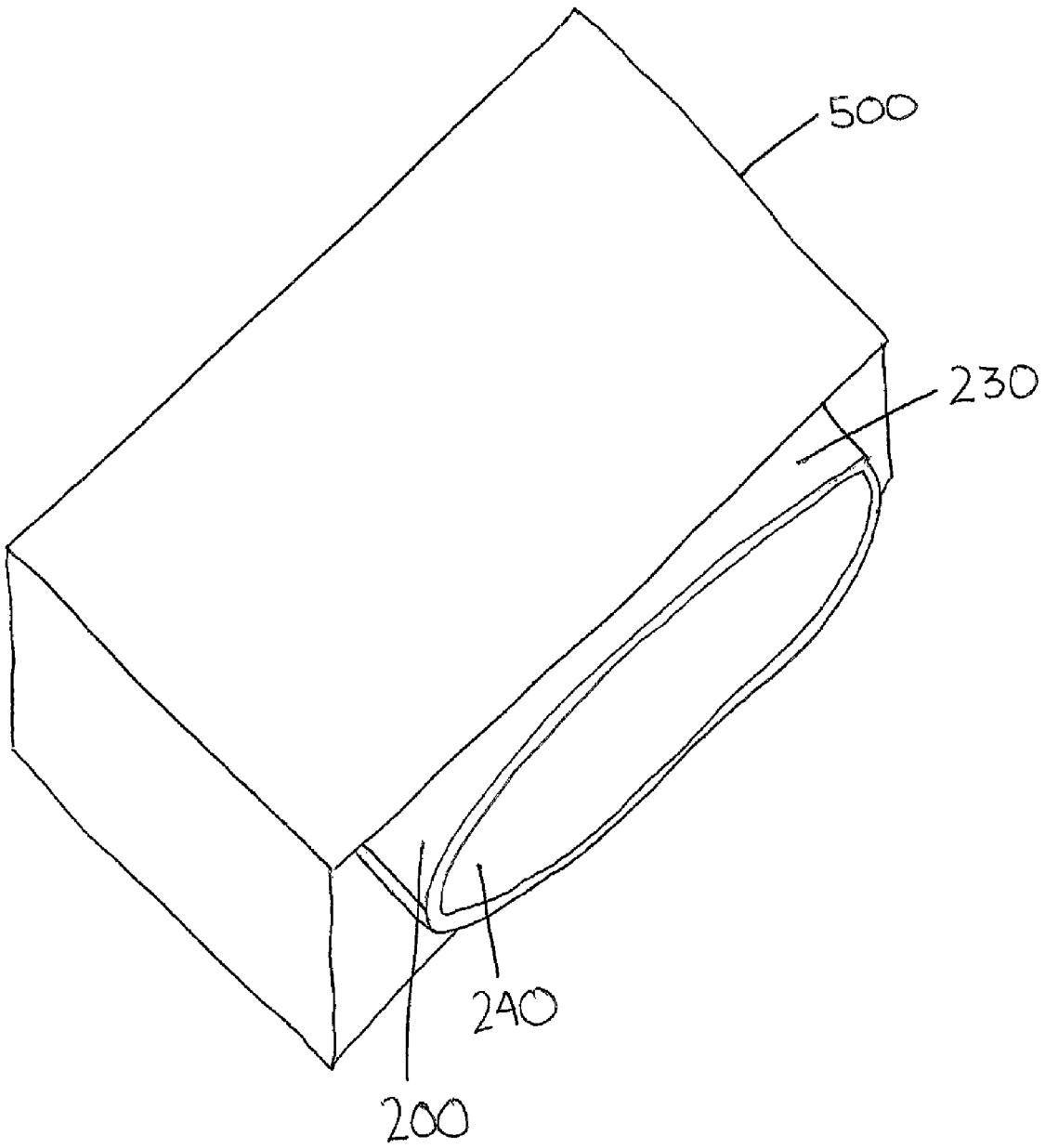
FIG. 4 is a perspective view of one embodiment of the invention having a product packaging sleeve disposed around a flexible shade.

An important aspect of the present invention is its utilization of shipping or packaging materials in the assembly of the knocked-down shade 200. The shipping or packaging materials used in the present invention are referred to as a product packaging sleeve 500. The product packaging sleeve 500 may also, for convenience, be referred to as a sleeve for purposes of this invention. The product packaging sleeve 500 must be an appropriate size and shape to fit within the interior surface of the flexible shade 200 when the flexible shade 200 is assembled. This size and shape can be determined by the manufacturer or the assembler. In the preferred embodiment, the manufacturer will use the product packaging sleeve 500 as protection for the knocked-down lamp shade 200 during shipment and transport. The knocked-down lamp shade 200 may be transported within the product packaging sleeve, as shown in FIG. 4. That is, the product packaging sleeve 500 is disposed around the exterior surface 230 of the flexible shade 200 when it is in a knocked-down state. In another configuration, the product packaging sleeve 500 is included in the shipping box with the knocked-down shade 200, but does not surround the knocked-down shade 200 during shipment. In yet a further configuration, the assembler may cut the shipping material to size to create the product packaging sleeve, either with directions from the manufacturer or based on the assembler's desired dimensions. Cardboard is a common packaging material, and can be used as the product packaging sleeve 500. But, this invention can be used with any type of product packaging that can provide sufficient support to retain one dimension (e.g. vertical) of the flexible shade 200. When the knocked-down shade is assembled, the product packaging sleeve 500 is secured to the interior 240 of the flexible shade 200 by the top and bottom rigid members 300 and 400.

The product packaging sleeve 500 can be, but does not have to be, continuous. For instance, it may be flat or otherwise not define a continuous surface. If the product packaging sleeve 500 is not continuous, then the assembler may desire to affix the product packaging sleeve's edges together, either prior to or after the sleeve 500 is disposed on the interior surface 240 of the flexible shade 200. Any suitable method of affixation may be used, including glue, staples, or tape. In one embodiment, the edges of the product packaging sleeve 500 overlap. The sleeve seam is shown in FIG. 2 at 510.

In accordance with the present invention, a method of assembly of a knocked-down shade is disclosed. This method, as shown in FIG. 1, includes first disposing the product packaging sleeve 500 along the interior surface 240 of the flexible shade cover 200. This step adds support between the top edge 210 and bottom edge 220 of the flexible shade cover 200. It also allows for the flexible shade cover 200 to keep the product's desired shape, which gives it structural integrity. Without the product packaging, the flexible shade 200 would not have enough structural integrity to stay in an open position and avoid collapsing in at least one dimension. Unlike the prior art, the flexible shade 200 used in the present invention does not need to have any vertical supports within or along the shade. As a result, the flexible shade cover 200 would revert back to its knocked-down state after time, at least in the vertical dimension. After the product packaging sleeve 500 is added to the flexible shade 200, FIG. 1 explains that the bottom rigid member 400 is then clipped to the interior 240 of the flexible shade 200. When the bottom rigid member 400 is clipped in place, it will press the product packaging sleeve 500 against the bottom edge 220 of the flexible shade 200. The top rigid member 300 is also clipped to the interior 240 of the flexible shade 200 so that it presses the product packaging sleeve 500 against the top edge 210 of the product packaging sleeve 500. In order to furnish a complete lamp product, one embodiment includes the final step of positioning the assembled flexible shade upon a bulb or lamp base.

Figure 6:
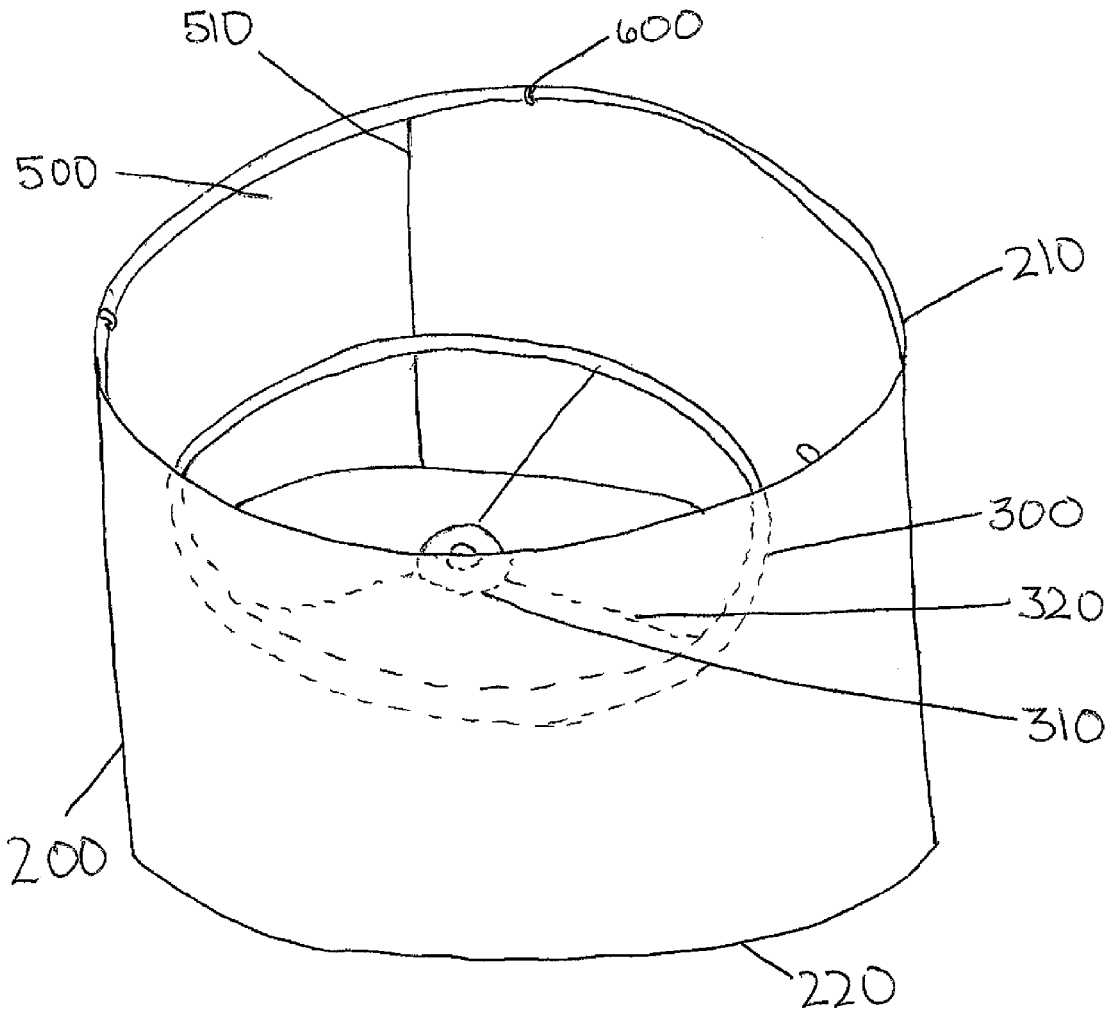
FIG. 6 is a perspective view of the assembly of the top rigid member according to one embodiment of the invention.
Figure 7:
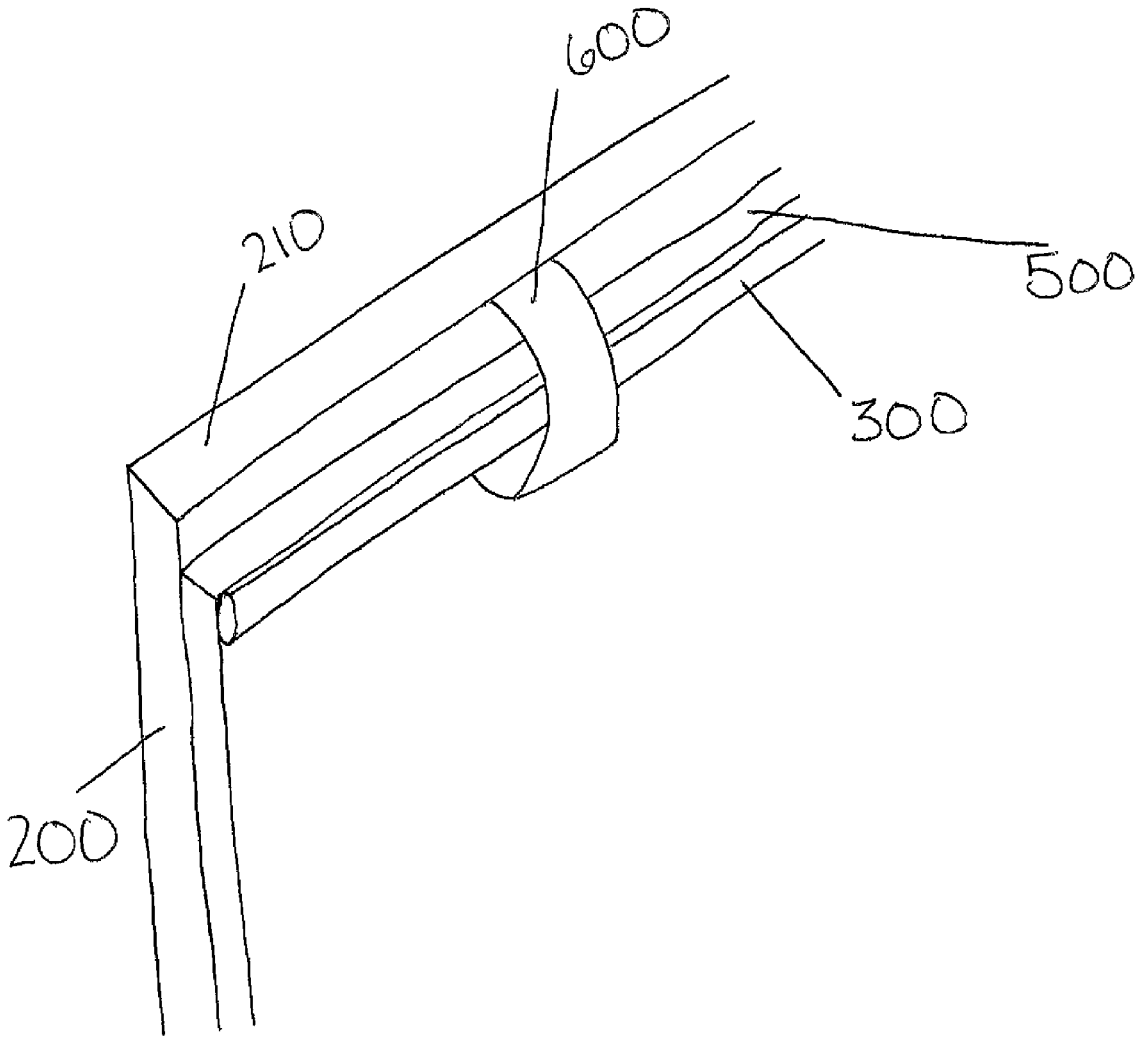
FIG. 7 is an enlarged fragmentary view taken on the line 7-7 of FIG. 4 showing the upper portion of the flexible shade assembly.

In one embodiment, the top rigid member 300 is clipped into place by positioning the top rigid member 300 within the flexible shade 200, as shown in FIG. 6. The clips 600 have access points known as accesses, which can be open or closed, for clipping the rigid members 300 and 400. Once the top rigid member 300 is positioned within the flexible shade 200, as shown in FIG. 6, it is then moved to the top edge 210 of the flexible shade 200 and through the accesses of the clips 600 to secure the top rigid member 300. This method of securing the top rigid member 300 may also cause the top rigid member 300 to press against the product packaging sleeve 500 so that it engages with, or is flat against, the interior surface 240 of the flexible shade 200, as shown in FIG. 7. The same procedure can be followed for the bottom rigid member 400, such that it is positioned within the flexible shade 200. The bottom rigid member is then moved to the bottom edge 220 of the flexible shade 200 and through the accesses of the clips 600 so as to secure the bottom rigid member 400. The clips 600 used in the present invention may be provided by the assembler, come with the knocked-down shade assembly, or come already attached to the interior 240 of the knocked-down shade assembly.

Variations of the assembly method shown in FIG. 1 may include the product packaging 500 surrounding the exterior surface 230 of the knocked-down flexible shade 200 prior to disposing the product packaging sleeve 500 along the interior the interior 240 of the flexible shade cover 200 and clipping the top and bottom rigid members 300 and 400. The flexible shade cover 200 may have to be removed from product packaging sleeve 500 prior to disposing the product packaging sleeve 500 along the interior 240 of the flexible shade cover 200.

If the product packing sleeve 500 is not in a continuous state, the assembler may wish to affix the edges of the product packaging sleeve 500 before or during assembly. This can be accomplished by bringing the two edges of the product packaging sleeve 500 together so that the product packaging sleeve 500 can function as a substantially continuous liner for the interior surface 240 of the flexible shade 200. This shown by the sleeve seam 510 in FIG. 2. In another embodiment, the edges of the product packaging 500 are brought together so that they overlap in order for the product packaging sleeve to be the appropriate size to fit along the interior surface 240 of the flexible shade 200.

Figure 8:
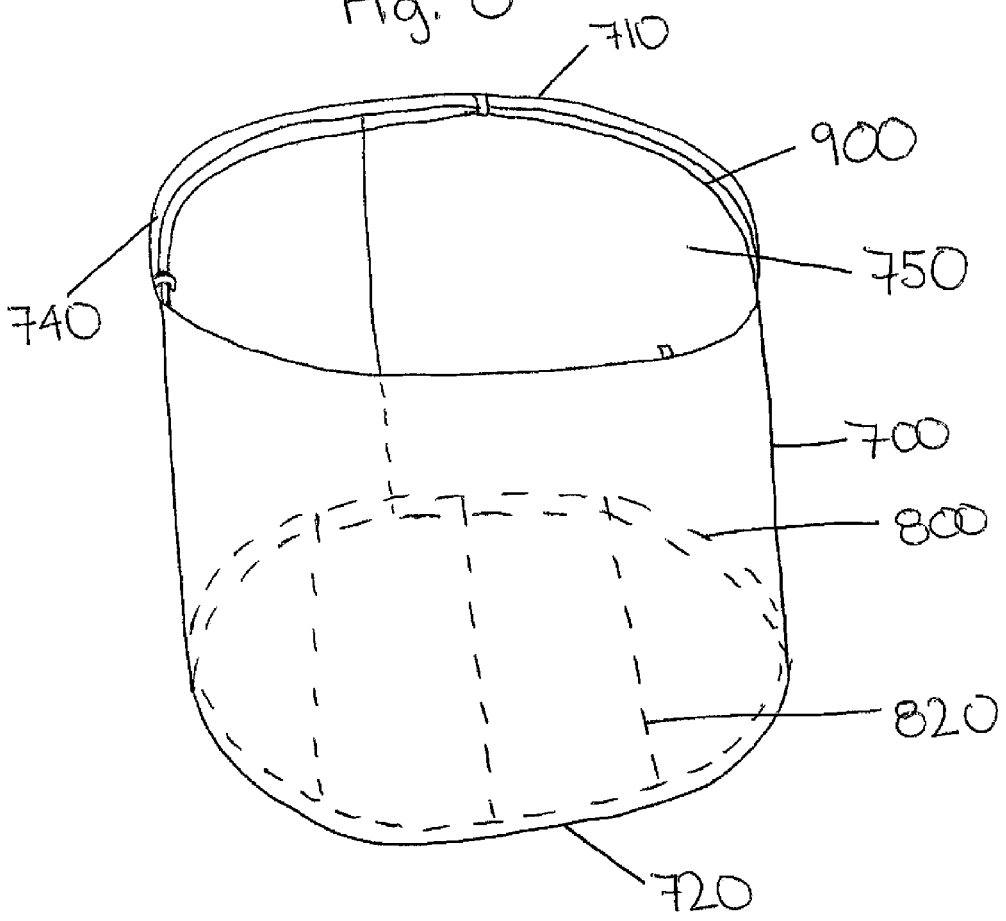
FIG. 8 is a perspective view of the knock-down portion assembly according to one embodiment of the invention.

In other embodiments, the inventive arrangement can apply to other knocked-down products besides lamp shades. For example, in certain embodiments of the invention, a fabric pencil holder or other decorative accessory can be assembled using a portion of product packaging attached to the flexible portion 700 by clipping or similar securement. In such embodiments, as shown in FIG. 8, there need only be an opening near a top 710 or a bottom 720 into which a rigid member is installed. Moreover, in other embodiments, there would be no need for a top rigid member to include an UNO fitting 310 and supports 320, though the rigid member can include different support 820 configurations, such as in a perpendicular or parallel configuration to suit a particular attachment that is needed, if any, for a given flexible article 700. In such alternative embodiments, a product packaging sleeve 750 is disposed within the flexible article 700 and secured to it substantially in the manner described above to impart structural integrity to the article. This embodiment can be assembled by disposing the product packaging sleeve 750 along an interior surface 740 of the flexible article 700. The product packaging sleeve 750 used may be of any suitable size or shape, and in one configuration, the assembler cuts the product packaging sleeve 750 to an appropriate size and shape based on specifications or perforations in the material from the manufacturer. At least a bottom rigid member 800 or top rigid member 900 is then clipped into place. Either or both rigid members is clipped on the interior of the flexible article 700 so that it engages, presses, or engages and presses the product packaging sleeve 750 against the flexible article 700 proximate to where the rigid member is clipped.

While the invention has been described in connection with certain embodiments, it is defined by the claims that accompany this description and is not to be read as being restricted to any one embodiment thereof.

What is claimed is:

1. A method of assembling a knocked-down shade suitable for covering a bulb seatable within a lamp base and being of the type which includes a flexible shade having a top edge which circumscribes a top opening and a bottom edge which circumscribes a bottom opening, a top rigid member having an UNO fitting for engaging the bulb of the lamp or a lamp socket, and a bottom rigid member, comprising:

withdrawing a flexible shade from within a product packaging sleeve;

disposing a product packaging sleeve along an interior surface of the flexible shade, the sleeve imparting structural integrity between the top and bottom edges thereof, wherein prior to or during the disposing step, bringing together a first end of the product packaging sleeve with a second end of the product packaging sleeve so as to define a substantially continuous liner for the interior surface of the flexible shade, wherein the first end and the second end of the product packaging sleeve are brought together so as to overlap;

first clipping the bottom rigid member to the flexible shade within the interior of the flexible shade so as to engage the product packaging sleeve against the flexible shade along the bottom edge thereof; and second clipping the top rigid member to the flexible shade within the interior of the flexible shade so as to engage the product packaging sleeve against the flexible shade along the top edge thereof.

2. The method as in claim 1, wherein the product packaging sleeve comprises product packaging disposed in surrounding relationship about an exterior surface of the flexible shade prior to the disposing and clipping steps, while the shade is knocked-down.

3. The method as in claim 2, including the additional step, prior to or during the disposing step, of bringing together a first end of the product packaging sleeve with a second end of the product packaging sleeve so as to define a substantially continuous liner for the interior surface of the flexible shade.

4. The method as in claim 1, wherein the second clipping step further comprising:

positioning the top rigid member within the flexible shade and adjacent accesses associated with a first set of clips, wherein the first set of clips is attached to the flexible shade proximate to the top edge, and moving the top rigid member through the accesses so as to secure the top rigid member using the first set of clips, wherein the moving step of the second clipping step includes causing the top rigid member to press against the product packaging sleeve and result in the engagement of the product packaging sleeve to the interior surface of the flexible shade.

5. The method as in claim 1, wherein the product packaging sleeve is a repurposed product packaging.

6. The method as in claim 1, wherein prior to or during the withdrawing step, the flexible shade, the top rigid member, and the bottom rigid member are initially within the packaging sleeve, whereby in a first condition, the flexible shade is within the sleeve; in a second condition, the product packaging sleeve is disposed along the interior surface of the flexible shade, imparting structural integrity between the top and bottom edges thereof; in a third condition, the bottom rigid member is clipped to the flexible portion within the interior of the flexible shade, engaging the product packaging sleeve against the flexible portion along the bottom edge thereof; in a fifth condition, the top rigid member is clipped to the flexible portion within the interior of the flexible shade, engaging the product packaging sleeve against the flexible portion along the top edge thereof.

7. A method of assembling a knocked-down accessory and being of the type which includes a flexible portion having at least one of a top edge which circumscribes a top opening or a bottom edge which circumscribes a bottom opening, a top rigid member, and a bottom rigid member, comprising:

withdrawing a flexible portion from within a product packaging sleeve;

disposing a product packaging sleeve along an interior surface of the flexible portion, the sleeve imparting structural integrity between the top and bottom edges thereof, wherein prior to or during the disposing step, bringing together a first end of the product packaging sleeve with a second end of the product packaging sleeve so as to define a substantially continuous liner for the interior surface of the flexible portion, wherein the first end and the second end of the product packaging sleeve are brought together so as to overlap;

first clipping the bottom rigid member to the flexible portion within the interior of the flexible shade so as to engage the product packaging sleeve against the flexible portion along the bottom edge thereof; and second clipping the top rigid member to the flexible portion within the interior of the flexible shade so as to engage the product packaging sleeve against the flexible portion along the top edge thereof.

* * * * *